US005531408A

United States Patent [19]

Wechselberger

[11] Patent Number: 5,531,408

[45] Date of Patent: Jul. 2, 1996

[54] RAILROAD SWITCH STAND

[75] Inventor: Emmerich E. Wechselberger, Glen Ellyn, Ill.

[73] Assignee: Chemetron-Railway Products, Inc., Wheeling, Ill.

[21] Appl. No.: 133,630

[22] Filed: Oct. 7, 1993

[51] Int. Cl.[6] ..... E01B 7/00

[52] U.S. Cl. ..... 246/257; 246/291; 246/320 R; 246/393

[58] Field of Search ..... 246/257, 258, 246/290, 291, 320, 393

[56] References Cited

U.S. PATENT DOCUMENTS

| | | | |
|---|---|---|---|
| 401,671 | 4/1889 | Alkins . | |
| 934,138 | 9/1909 | Cheatham | 246/489 |
| 939,279 | 11/1909 | Legault . | |
| 1,127,959 | 2/1915 | Burns | 246/406 |
| 1,246,698 | 11/1917 | Armuth | 246/406 |
| 1,325,396 | 12/1919 | Cuellar . | |
| 1,789,894 | 1/1931 | Coleman . | |
| 1,886,987 | 11/1932 | Taylor | 246/393 X |
| 2,092,828 | 9/1937 | Bone | 246/406 X |
| 2,468,024 | 4/1949 | Blythe | 246/291 |
| 2,510,815 | 6/1950 | Granche | 246/393 |
| 2,559,477 | 7/1951 | Stephenson | 246/406 |
| 2,641,690 | 6/1953 | McLeish | 246/406 X |
| 2,707,230 | 4/1955 | Beltman et al. | 246/393 X |
| 3,136,509 | 6/1964 | Magnus | 246/393 |
| 3,158,345 | 11/1964 | Wilhelm et al. | 246/258 |
| 3,355,585 | 11/1967 | Schwab | 246/393 |
| 3,363,097 | 1/1968 | Wilhelm et al. | 246/393 |
| 3,418,462 | 12/1968 | Wilson et al. | 246/393 |
| 3,483,368 | 12/1969 | Wilson | 246/393 |
| 3,601,606 | 8/1971 | Cook | 246/258 |
| 3,621,237 | 11/1971 | Hylen | 246/411 |
| 3,652,849 | 3/1972 | Kleppick | 246/393 |
| 3,691,371 | 9/1972 | Hylen | 246/393 |
| 3,708,660 | 1/1973 | Speight | 246/411 X |
| 4,428,552 | 1/1984 | Frank et al. | 246/393 |
| 4,824,054 | 4/1989 | Kohake et al. | 246/406 |
| 4,938,438 | 7/1990 | Farrell et al. | 246/406 |
| 5,014,937 | 5/1991 | Peters | 246/406 |
| 5,052,642 | 10/1991 | Peters | 246/393 |

*Primary Examiner*—Robert J. Oberleitner
*Assistant Examiner*—S. Joseph Morano
*Attorney, Agent, or Firm*—Welsh & Katz, Ltd.

[57] ABSTRACT

A railroad switch stand for actuating a rail switch between open and thrown positions includes, in one embodiment, an upstanding frame supporting a handwheel at approximately chest height for movement between a first position enabling manual rotation of an upstanding throw shaft to actuate a horizontal rail switch throw rod, and a second position enabling powered rotation of the throw shaft to open or throw the rail switch points. In alternative embodiments, low profile railroad switch stands are adapted for interconnection to a rail switch throw rod through fluid pressure or electric motor actuators and associated constant force spring actuators in a manner to apply a substantially constant force to the throw rod in maintaining the rail switch in open or thrown positions. The constant force spring actuators provide overload protection and automatic reset in the event a train runs through a rail switch lined against it. In all embodiments, a switch target is positively interconnected to the throw rod and provides a visual indication of the exact position of the rail switch.

9 Claims, 3 Drawing Sheets

RAILROAD SWITCH STAND

BACKGROUND OF THE INVENTION

The present invention relates generally to railroad switch stands, and more particularly to a novel railroad switch stand having in one embodiment the capability for chest height handwheel or powered actuation, and in other embodiments having a low profile with provision for electrical, fluid pressure powered or manual actuation.

Since the advent of railroads, switch stands have been employed to selectively divert rail cars from a primary track route to a secondary track, such as a siding or the like, and vice versa. U.S. Pat. No. 401,671 illustrates one type of railway switch stand still in common usage. This type of switch stand is operated by lifting and rotating a weighted rod from one position to another, thereby having the significant disadvantage of subjecting the switchman to potential back and leg injury.

Another type of switch stand in common usage is known as the HIGHSTAR manufactured by Pettibone-Mulliken. This switch stand includes a vertical throw shaft with a link affixed to the lower end extending outwardly on opposed sides thereof. Each end of the link includes an upwardly extending boss selectively and pivotally received in a pivot hole defined in the outboard end of the switch throw rod. A pair of retaining brackets retain the throw rod engaged with the selected boss. The throw shaft also includes a vertically pivotal, lockable, outwardly extendable handle used as a lever to rotate the throw shaft. The upper end of the throw shaft supports a banner or target for indicating the position of the rail switch.

U.S. Pat. No. 1,325,396 discloses a switch stand which employs a rotatable wheel mounted at track level. This requires a switchman to bend over to operate the wheel, thereby subjecting the switchman to potential back injury. Additionally, this type of switch does not provide a mechanism for automatically locking the switch stand in the open or thrown position, or include means to indicate the exact position of the switch, such as in a position between its open and thrown positions.

Attempts to improve on prior commonly used switch stand designs have resulted in switch stands which have not met widespread acceptance and usage because of mechanical complexity and associated installation and maintenance costs. For example, U.S. Pat. No. 3,652,849 discloses a switch stand having a foot-operated, switch-connected lever movable to operate a rail switch between open and thrown positions. This type of switch stand, however, presents greater mechanical complexity than desired and may become inoperable if snow or gravel becomes piled under the foot pedals of the device.

U.S. Pat. No. 4,824,054, which is incorporated herein by reference, discloses a railroad switch stand of relatively simple yet highly effective construction and which has numerous advantages over prior switch stands. This switch stand is more easily operated by a switchman without bending over, and facilitates automatic locking and disconnection in the event a train runs through the switch when lined against it. This switch stand has a hand-operable rotatable throw wheel mounted at about normal chest height, means coupling the throw wheel with the throw rod for translating rotation of the throw wheel into longitudinal movement of the rod, a locking bar for selectively engaging and preventing rotation of the throw wheel, and shear means enabling disconnection of the throw rod if excessive axial force is applied thereto, such as by a rail car running through the switch when lined against it.

OBJECTS AND SUMMARY OF INVENTION

A general object of the present invention is to provide a new and improved railroad switch stand that provides significant advantages over prior switch stands.

A more particular object of the present invention is to provide a novel railroad switch stand which, in various embodiments, applies a substantially constant force to a throw rod as it is actuated in both directions so that a constant force is applied to the switch points in both their switch-thrown and switch-open positions.

Another object of the present invention is to provide a novel railroad switch stand which, in various embodiments, provides overload protection in the event a train runs through the switch when lined against the train, and effects automatic reset if the switch is actuated against its intended position by a train running through the switch when lined against it.

Still another object of the present invention is to provide a novel railroad switch stand which, in various embodiments, has a relatively low profile and enables powered actuation of the rail switch between open and thrown positions, and which further facilitates remote actuation such as by an engineer in a locomotive as it approaches the switch and after passing through the switch.

A feature of one embodiment of a railroad switch stand in accordance with the present invention lies in the provision of a crank arm operator to actuate the throw rod in moving the rail switch points, the crank arm being power operated and being disposed in axial alignment with the throw rod when in its switch open and thrown positions so as to maintain force on the switch points in the event the power source is interrupted.

Another feature of the railroad switch stand in accordance with the invention lies in providing a switch target which is interconnected to the rail switch throw rod in a manner to always provide a visual indication of the exact position of the rail switch.

A further feature of one embodiment of the switch stand in accordance with the invention lies in providing a handwheel actuator disposed at chest height and operable in one mode to enable manual rail switch actuation between open and thrown positions, and operable in a second mode to enable powered switch actuation.

In carrying out the present invention, a railroad switch stand is provided which, in one embodiment, employs a handwheel supported at approximately chest height and adapted for interconnection to an upstanding rotatable throw shaft which in turn is coupled to a horizontal throw rod responsive to manual rotation of the handwheel to open or throw the rail switch points. The handwheel is adapted for movement to a position disabling manual operation while simultaneously engaging the upstanding throw shaft with power means, such as a drive motor and associated gear reducer assembly, to enable powered actuation of the throw rod between switch point open and thrown positions.

In alternative embodiments, low profile railroad switch stands are adapted for interconnection to the throw rod through spring actuators in a manner to apply a substantially constant force to the switch points in both their open and thrown positions, the spring actuators in turn being actuated by electric motor drives or fluid pressure actuators so as to enable powered actuation and remote control of the switch points without subjecting an operator to potential back or leg injury as heretofore encountered. The constant force spring actuators provide overload protection and automatic reset in the event a train runs through a switch lined against it. In some embodiments, the spring actuators are connected to electric or fluid pressure operators through crank arms which are disposed in axial alignment with the associated spring actuators and throw rods when in their switch open and switch thrown positions, thereby preventing inadvertent movement of the crank arms.

In all embodiments, a switch target is supported in upstanding relation and is positively interconnected to the throw rod so as to provide a continuous visual indication of the exact position of the rail switch points; that is, whether they are in open, thrown or intermediate switch positions.

Further objects, features and advantages of the present invention, together with the organization and manner of operation thereof, will become apparent from the following detailed description of the invention when taken in conjunction with the accompanying drawings wherein like reference numerals represent like elements throughout the several views.

DETAILED DESCRIPTION

Figure 1:
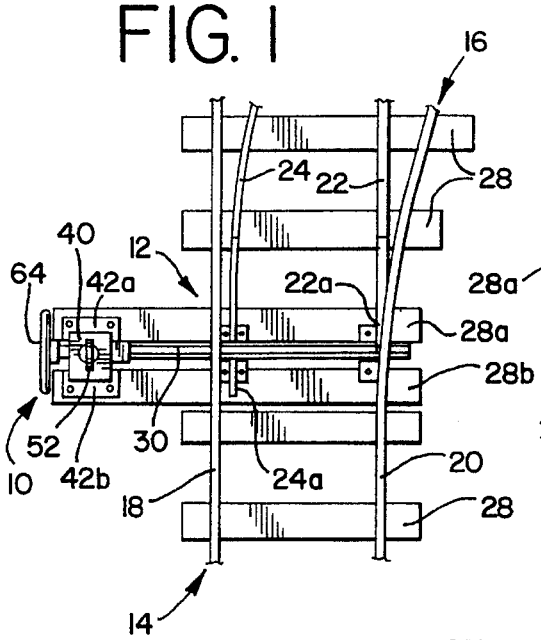
FIG. 1 is a fragmentary plan view illustrating a switch stand in accordance with the present invention in operative association with a railroad switch.
Figure 3:
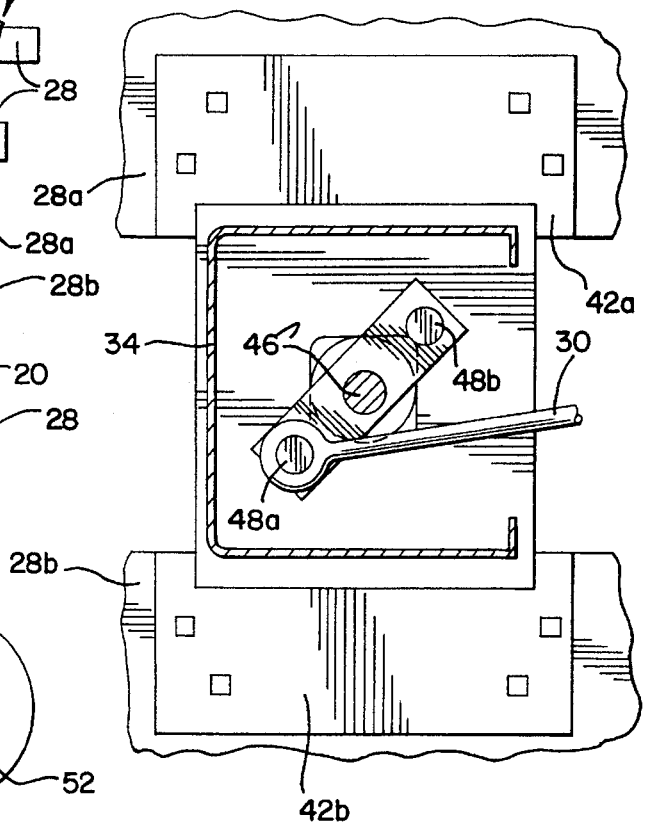
FIG. 3 is a horizontal sectional view taken substantially along line 3—3 of FIG. 2.
Figure 2:
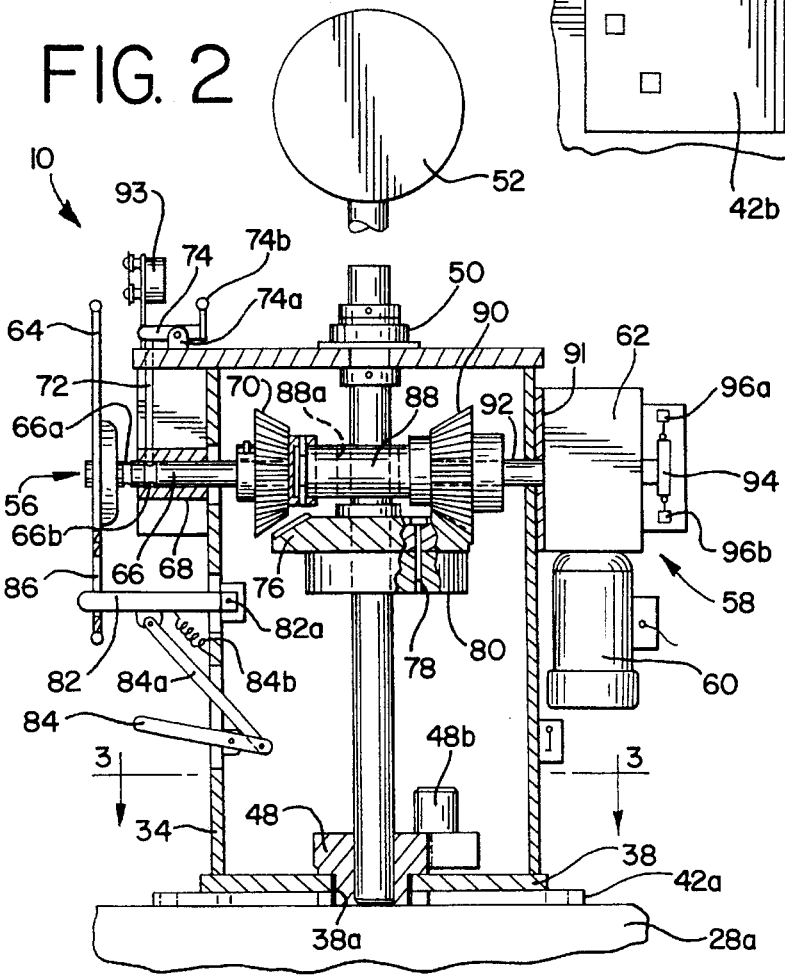
FIG. 2 is a vertical sectional view, on an enlarged scale, through the switch stand of FIG. 1 and illustrating internal components.

Referring now to the drawings, and in particular to FIGS. 1–3, a railroad switch stand constructed in accordance with one embodiment of the present invention is indicated generally at 10. The switch stand 10, which may alternatively be termed a rail switch actuating mechanism, is illustrated in FIG. 1 in operative relation with a conventional rail switch, indicated generally at 12. The rail switch 12 enables a train or one or more rail cars traveling along a relatively straight track section 14, termed a main track, to be diverted to a siding or branch track 16. The rail switch includes a fixed straight rail 18, a fixed curved rail 20, a movable straight rail 22 and a movable curved rail 24, all of which are supported on transverse ties 20 on a suitable road bed, as is known. The movable straight and curved rails 22 and 24 have ends 22*a* and 24*a*, respectively, which comprise the rail switch points and are connected to a throw rod 30 supported between a pair of extended length ties 28*a* and 28*b* in transverse relation to the straight rails 18 and 22. As is known, the throw rod 30 is longitudinally movable in response to actuation of the switch stand 10 to move the rail ends or switch points 22*a* and 24*a* between open switch positions, wherein rail end 22*a* abuts rail 20 and rail end 24*a* is spaced from rail 18 so as to allow a train car or locomotive to pass through the rail switch 12 along the main track section, and a thrown switch position wherein the rail end 22*a* is spaced from the curved rail 20 and the rail end 24*a* abuts the straight rail 18 so that a locomotive and/or rail car moving along the straight track section (from bottom to top as viewed in FIG. 1) will be diverted onto the siding or branch track 16.

Referring to FIGS. 2 and 3, the switch stand 10 includes an upstanding frame member 34 having a generally C-shaped transverse cross section. The frame member 34 is fixed at its lower end to a base plate 38 and has its upper marginal edge fixed to a transverse top plate 40. The base plate 38 is secured to a pair of laterally opposite mounting plates 42*a* and 42*b* which facilitate mounting of the switch stand on and between the ties 28*a* and 28*b* by suitable means such as spikes or other fastening means. The upstanding frame member 34, base plate 38 and top plate 40 are preferably made of suitable strength steel and are welded together to form an integral rigid upstanding frame.

The frame 34 supports an upstanding cylindrical drive shaft 46 which may be termed a throw shaft and has its lower end supported within and fixed to a crank arm or actuating lever 48. The crank arm 48 is rotatably supported within a suitable aperture 38*a* formed centrally in the base plate 38. The upper end of the throw shaft 46 extends through a support bearing 50 in the top plate 40 and has a circular target or banner plate 52 mounted on its upper end. The target plate 52 is supported at a height sufficient to provide a visual indication of the exact position of the rail switch points; that is, whether the switch points are in open, thrown or intermediate positions. Conventionally, the target or banner 52 is colored red and is disposed in a plane transverse to rail 18 when the rail switch 12 is in a thrown position. The target plate is rotated to a position substantially parallel to the rail 18 when the rail switch 12 is in an open position enabling a train to pass through the rail switch. Any other position of the target plate indicates that the rail switch points are in positions intermediate their open or thrown positions.

The crank arm 48 has a pair of upstanding bosses or stub shafts 48*a* and 48*b* adapted for individual pivotal connection to the proximal end of the throw rod 30 so that with the throw rod connected to one of the stub shafts, 90° rotation of the drive shaft 46 effects longitudinal movement of the throw rod and thereby effects movement of the rail switch 12 between its open and thrown positions. The drive or throw shaft 46 may be rotated to effect longitudinal movement of the throw rod 30 by either manual actuating means, indicated generally at 56, or power means 58 in the form of an electric drive motor 60 and associated gear reducer 62. The manual actuating means 56 includes a hand-operable rotatable throw wheel or handwheel 64 which is fixed on the outer end of a cylindrical actuating shaft 66. The actuating shaft 66 is supported at approximately waist height by a bearing block 68 fixed to the upstanding frame 34 such that the axis of the shaft 66 is disposed transverse to the drive shaft 46. The diameter of the handwheel 64 is such that with the shaft 66 at waist height, the handwheel may be readily grasped at chest height. The shaft 66 is rotatable and axially slidable within the bearing block 68 and carries a bevel gear 70 in fixed relation on its inner end. The shaft 66 has a pair of annular grooves or recesses 66*a* and 66*b* formed about its outer periphery, each of which is adapted to receive the lower end of a downwardly biased shaft retaining rod 72. The rod 72 extends vertically through a guide aperture in the top plate 40 and has its upper end pivotally connected to an actuating lever 74 which is pivotally supported at 74*a* on the top plate and has an actuating handle 74*b*. The annular groove 66*a* is positioned along the shaft 66 so as to establish an inner manual operating position for the handwheel 64 wherein the groove 66*a* underlies the lower end of rod 72 and the bevel gear 70 meshes with a bevel gear 76 mounted coaxially on the throw shaft 46. With the handle 74*b* raised to extend the lower end of locking rod 72 into groove 66*a*, the shaft 66 and handwheel 64 are maintained in inner operating positions wherein rotation of handwheel 64 effects rotation of throw shaft 46. Depressing the handle 74*b* retracts the lower end of rod 72 from groove 66*a* enabling the handwheel 64, shaft 66 and gear 70 to be manually pulled outwardly to release gear 70 from bevel gear 76.

The annular groove 66*b* is spaced longitudinally from groove 66*a* so that when the handwheel 64, shaft 66 and bevel gear 70 are moved to their outer positions disengaging gear 70 from gear 76, groove 66*b* underlies the lower end of the locking rod 72. The actuating handle 74*b* may then be raised to extend rod 72 into engagement with groove 66*b* and maintain shaft 66 in its outer position while enabling rotation thereof.

The bevel gear 76 is rotatable relative to shaft 46, but is normally interconnected by a shear pin 78 to a shear arm 80 which is fixed on shaft 46. With the bevel gear 70 in its inner operating position meshing with bevel gear 76, manual rotation of the handwheel or throw wheel 64 effects rotation of the drive shaft 46 and longitudinal movement of the throw rod 30 to move the rail switch 12 from an open to a thrown position or from a thrown to an open position depending on the rotational direction imparted to the handwheel. The gear ratio between bevel gears 70 and 76 is such that a full revolution of the handwheel 64 effects a 90° rotation of the throw shaft 46 and crank arm 48. After rotating the handwheel 64 to manually open or throw the rail switch 12, the handwheel, and thus gear 70 and throw shaft 46, may be locked in rotational position by a locking bar 82. The locking bar 82 is pivotally supported at 82*a* on the frame 34 and is adapted for pivotal movement through a foot pedal 84 and connecting link 84*a* to extend through a slot or opening 86 in the handwheel and prevent rotation thereof similar to the locking bar arrangement disclosed in U.S. Pat. No. 4,824,054. The locking bar 82 is preferably biased to a downward pivot position by a tension spring 84*b*.

Should the rail switch 12 be in a thrown position with the rail end 24*a* abutting rail 18, and with the shaft 66 prevented from rotating by the locking bar 82, it will be appreciated that a train running through the thrown rail switch 12 (from top to bottom as viewed in FIG. 1) will forcibly spread rail switch point 24*a* from the rail 18 and cause a substantial axial force to be exerted on the throw rod 30 in a direction to urge rotation of the bevel gear 70. However, because the locking bar 82 is preventing rotation of handwheel 64 and bevel gear 70, the shaft 46 and gears 70 and 76 are subjected to potentially damaging stress forces. Such damage is prevented by the shear pin 78 which shears and thereby serves as disconnecting means when a train inadvertently runs through the thrown switch when lined against such movement of the train. Similarly, the shear pin 78 prevents damage to the switch stand in the event a switchman attempts to throw the rail switch 12 by releasing the locking bar 82 and forcibly rotating the handwheel 64 when the space between the rail end 24*a* and rail 18 is blocked with snow, gravel or other debris.

As aforedescribed, the switch stand 10 is adapted for either manual operation through the handwheel 64, or powered actuation through the power actuating means 58. To effect powered operation of the switch stand 10, the operator releases the shaft retaining rod 72 from the annular recess 66*a* and pulls the handwheel 64 and actuating shaft 66 longitudinally outwardly from the stand frame 34 to a position wherein the groove 66*b* underlies the rod 72 which can be depressed to engage groove 66*b* as illustrated in FIG. 2. The bevel gear 70 is connected to a tubular coupling sleeve 88 in a manner to effect axial movement of sleeve 88 in response to axial movement of shaft 66 but allowing shaft 66 to rotate without rotating sleeve 88. The sleeve 88 has an elongated transverse slot 88*a* which receives the throw shaft 46 therethrough so as to enable rotation of shaft 46 while also allowing longitudinal movement of coupling sleeve 88. The end of sleeve 88 opposite shaft 66 is similarly connected to a bevel gear 90 which is slidable on and rotatable with a splined output shaft 92 of the gear reducer 62. In this manner, axial movement of sleeve 88 effects axial movement of bevel gear 90 while enabling relative rotation between gear 90 and sleeve 88. The gear reducer 62 is supported on the upstanding frame 34 through a transverse support plate 91 so that output shaft 92 is axially aligned with the actuating shaft 66 and coupling sleeve 88.

With the actuating shaft 66 and handwheel 64 moved to their outer positions so that the annular groove 66*b* is engaged with the retaining rod 72, the bevel gear 70 is spaced from the bevel gear 76 and bevel gear 90 meshes with bevel gear 76. Energizing the drive motor 60, as through a control switch 93, rotates the drive shaft 46 through bevel gears 90 and 76 to effect longitudinal movement of the throw rod 30. The gear reducer 62 carries a cam actuator 94 which cooperates with a pair of limit switches 96*a* and 96*b* connected in circuit with the drive motor 60 so that the drive motor 60 is energized only long enough to effect a 90° rotation of the drive shaft 46 and thereby move the throw rod 30 between its rail switch open and thrown positions. The limit switches 94*a* and 94*b* and associated control circuit to drive motor 60 serve to condition the drive motor for rotational reversal after each successive rotation of the drive shaft 46 through 90°. The electric motor 60 has a conventional solenoid operated spring biased brake which prevents rotation of the motor, and thereby rotation of bevel gear 90, when motor 60 is deenergized. Energizing motor 60 releases the motor brake.

In similar fashion to manual operation of the switch stand 10, the shear pin 80 serves to prevent damage to the bevel gear 90 and/or gear reducer 62 and drive motor 60 in the event an attempt is made to throw the rail switch 12 when foreign material prevents movement of the rail end 24*a* into abutting relation with the rail 18. Conversely, should the rail switch 12 be in a thrown position, the shear pin 80 prevents damage to the switch stand should a train inadvertently attempt to pass through the rail switch when lined against such train movement.

Figure 4:
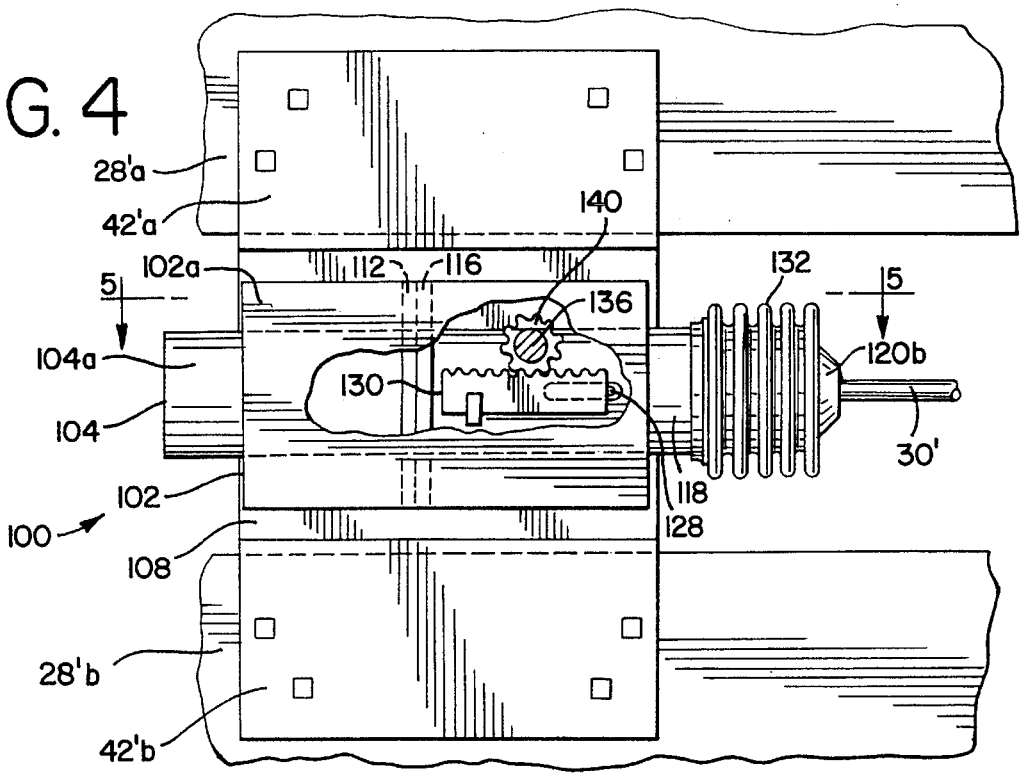
FIG. 4 is a fragmentary plan view of a low profile switch stand or actuating mechanism in accordance with an alternative embodiment of the present invention, portions being broken away for clarity.
Figure 5:
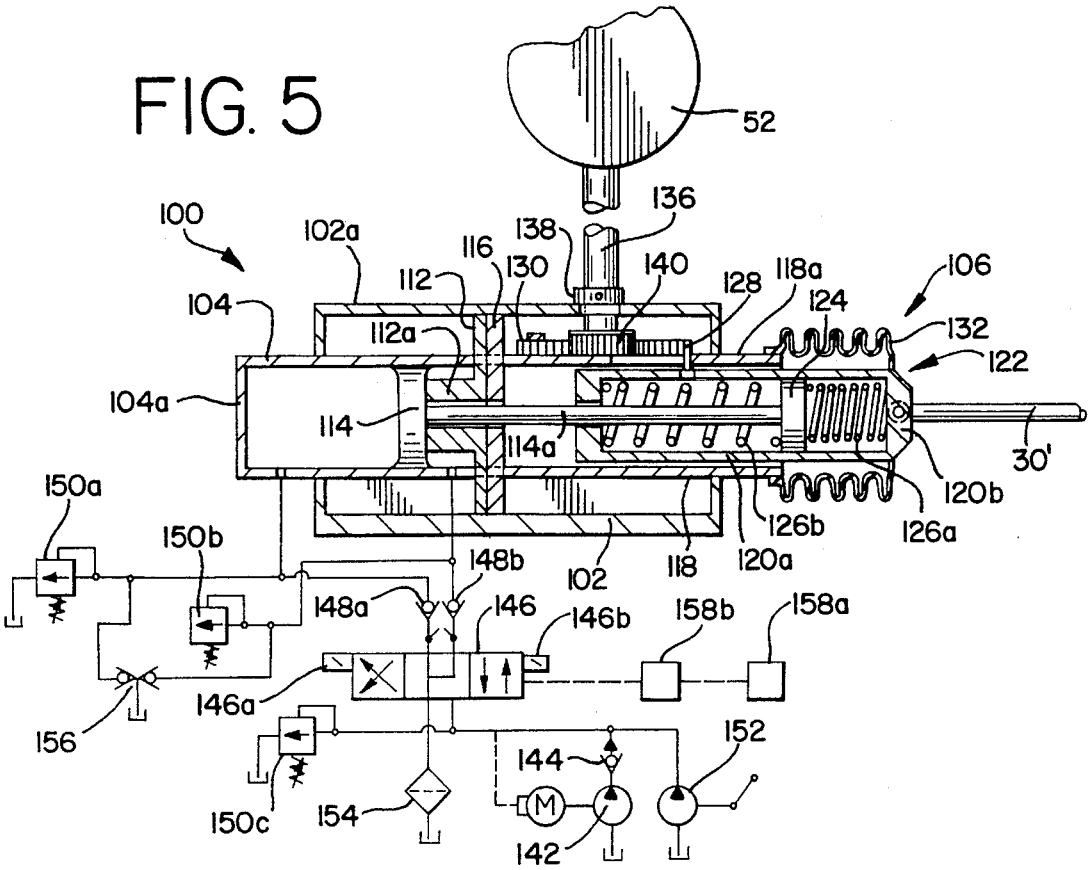
FIG. 5 is a vertical sectional view of the switch stand of FIG. 4 in conjunction with a schematic control circuit.

FIGS. 4 and 5 illustrate an alternative embodiment of a railroad switch stand, indicated generally at 100, constructed in accordance with the present invention. The railroad switch stand 100, which may alternatively be termed a low-profile rail switch actuating mechanism, finds particular application where a low profile rail switch actuating mechanism is desired.

The railroad switch stand or actuating mechanism 100 includes frame means in the form of a generally rectangular housing 102 which houses and supports rail switch actuating means in the form of a fluid pressure actuating cylinder 104 and a constant force spring actuator 106. The spring actuator 106 is pivotally connected to a proximal end of a throw rod 30' and is responsive to actuation of the fluid pressure cylinder 104 to effect longitudinal movement of the throw rod. The end of the throw rod 30' opposite the constant force actuator 106 is connected to a pair of movable rails of a rail switch, such as the movable switch points 22*a* and 24*a* of the rail switch 12, in similar fashion to the throw rod 30. The housing 102 is adapted for mounting on a base plate, such as base plate 108, which in turn is fixed to a pair of mounting plates 42'*a* and 42'*b* for mounting the switch stand on and between a pair of adjacent ties 28'*a* and 28'*b* such that the housing 102 is disposed in axial alignment with the throw rod 30'.

The fluid pressure cylinder 104 may comprise a hydraulic or pneumatic cylinder having a closed end 104*a* and an opposite open end secured to a rectangular end plate 112, as by welding. The end plate 112 is fixed within the rectangular housing 102 and has a generally cylindrical boss 112*a* formed thereon which extends into the cylinder 104 a predetermined distance to establish a stop for a piston 114 slidable within the cylinder 104. The piston 114 has a piston rod 114*a* which extends centrally through an axial bore in the boss 112*a* and through a central opening in a mounting plate 116 which is also mounted within the housing 102 in abutting relation with the plate 112. The mounting plate 116 supports a cylindrical tubular sleeve 118 in axially aligned relation with the cylinder 104. The cylinder 104 and sleeve 118 may be of equal diameter and are supported by housing 102 such that the longitudinal axis of the cylinder and sleeve substantially coincides with the longitudinal axis of the throw rod 30'.

The piston rod 114*a* extends into a generally cylindrical housing 120 of the constant force spring actuator 106. A cylindrical piston 124 is fixed to the end of the piston rod 114*a* within a cylindrical wall 120*a* of the spring actuator housing. The spring actuator housing 120 is longitudinally slidable within the sleeve 118 and has a closed end 120*b* pivotally connected to the throw rod 30'. A pair of substantially identical constant force coil compression springs 126*a* and 126*b* are disposed within the spring actuator housing 120 and act on opposite sides of the piston 124 so as to normally urge the actuator 106 to a position wherein the piston 124 is centered internally of the spring actuator housing 120. The spring actuator 106 has an arm 128 fixed radially on the wall 120*a* so as to extend upwardly through an elongated longitudinal slot 118*a* formed in the sleeve 118. The arm 128 prevents rotation of the spring actuator 106 about its longitudinal axis, but allows longitudinal movement of the spring actuator relative to sleeve 118.

A rectilinear gear rack 130 has one end fixed to the arm 128 and is slidable along the upper surfaces of the sleeve 118 and cylinder 104 so as to move longitudinally in response to movement of the spring actuator 106. Preferably, a resilient boot 132 has its opposite ends secured to the outer end of the sleeve 118 and the closed end 120*b* of the spring actuator 106 so as to prevent foreign matter from entering the free end of sleeve 118 peripherally of actuator housing 120 while enabling longitudinal movement of the spring actuator relative to the sleeve.

An upstanding target support shaft 136 is supported by the housing 102 through a suitable bearing 138 such that the lower end of the support shaft extends into the housing 102 through a top cover 102*a*. The lower end of the target support shaft 136 has a pinion gear 140 fixed thereon which meshes with the gear rack 130 so as to effect rotation of the support shaft 136 in response to longitudinal movement of the throw rod 30'. The upper end of the support shaft 136 supports a target 52 which is positively interconnected to the throw rod 30' and thereby provides a visual indication of the exact position of the associate rail switch in substantially the same manner as the target or banner 52 of the railroad switch stand 10.

The fluid pressure cylinder 104 is connected to either a pneumatic or hydraulic control circuit so as to enable selective movement of the piston 114 and thereby the constant force spring actuator 106 to effect a corresponding longitudinal movement of the throw rod 30'. In the illustrated embodiment, the fluid pressure control for the fluid pressure cylinder 104 includes a motor driven hydraulic pump 142 which is connected through a check valve 144 to a three-way solenoid control valve 146 having solenoid actuators 146*a* and 146*b*. The solenoid control valve 146 is connected through a pilot operated check valve assembly 148 having check valves 148*a* and 148*b* connected in line with the head end and piston end, respectively, of the fluid pressure cylinder 104. A pair of adjustable pressure relief valves 150*a* and 150*b* are connected to the head and piston rod ends of the fluid pressure cylinder 104 to provide safety fluid pressure overload protection for cylinder 104. A manual hydraulic pump, such as a hand or foot operated pump 152, is also adapted for supplying hydraulic pressure through the solenoid control valve 146 to the head and piston ends of the fluid pressure cylinder 104 in the event the power source to the pump 142 becomes incapacitated.

Each of the check valves 148*a* and 148*b* is responsive to a pilot pressure in the opposite line, as through crossover lines, so as to open and allow fluid flow from the corresponding head or piston end of the cylinder 104 when the opposite end of the cylinder is pressurized through the control valve 146. For example, when the control valve 146 is conditioned to pressurize the head end of cylinder 104, the check valve 148*b* senses this pressure and opens to enable discharge of fluid pressure from the piston end of cylinder 104 through a filter 154 to the fluid reservoir. Conversely, with the control valve 146 conditioned to pressurize the piston end of the cylinder 104, check valve 148*a* opens to vent the head end of the cylinder to the reservoir. A conventional anti-cavitation valve 156 is connected to the head and piston ends of cylinder 104 to prevent cavitation during operation. A pressure relief valve 150*c* is also connected to the output side of the pump 142 to protect the pump. When the hydraulic pump 142 and solenoid control valve 146 are deenergized, both of the check valves 148*a* and 148*b* are closed to maintain either the head or piston end of cylinder 104 under pressure so as to maintain the rail switch 12 in its selected open or thrown position.

In operation, and with the control valve 146 conditioned to pressurize the head end of the fluid pressure cylinder 104 so as to extend the piston rod 114*a*, the constant force spring actuator 106 applies a substantially constant longitudinal force on the throw rod 30' through coil compression spring 126*a* and thereby applies a substantially constant force on the rail switch points to maintain them in open positions, as shown in FIG. 1. In this position of the rail switch, should a locomotive or rail car on the siding 16 be caused to run through the open rail switch onto the main track 14, the rail point 22*a* will be forced away from rail 20. This will cause the throw rod 30' to move the spring actuator housing 120 in a direction to further compress spring 126*a* without overloading or damaging the various components. After the rail car from the siding has passed through the rail switch, the spring 126*a* will return the rail switch points to their open positions. If the force acting longitudinally on the throw rod 30' is sufficient to fully compress the spring 126*a*, the piston 114 will be urged toward the head end of actuating cylinder 104. If the resulting pressure buildup in the head end of cylinder 104 exceeds the setting of the pressure relief valve 150*a*, fluid pressure from the head end of cylinder 104 will be vented to the reservoir.

When it is desired to throw the rail switch to facilitate passage of rail cars onto the siding 16 from the main track 14, the switchman actuates the solenoid control valve 146, either through a suitable push button switch, such as the switch 93 which may be mounted on the switch stand, or by remote means such as a suitable remote transmitter and receiver, indicated schematically at 158*a* and 158*b*, respectively. In the latter case, the receiver 158*b* is connected to the solenoids 146*a,b* of control valve 146 so as to energize a selected one of the solenoids in response to a predetermined corresponding signal transmitted by the transmitter 158*a*. Such remote control systems are well known and used, for example, in remote control opening and closing of roll-up and overhead doors.

With the head end of cylinder 104 pressurized to maintain the switch points in their open positions, actuating the control valve 146 to pressurize the piston end of pressure cylinder 104 causes the check valve 148*a* to open and connect the head end of cylinder 104 to the reservoir or tank. This causes the piston rod 114*a* to move to the left, as viewed in FIG. 5, so as to move the spring actuator 106 and throw rod 30' in a corresponding direction and throw the rail switch, i.e. move switch point 22*a* away from rail 20 and move switch point 24*a* against rail 18. The coil spring 126*b* will thereafter apply a substantially constant force on the rail points 22*a* and 24*a* to maintain them in their thrown positions. Should a train thereafter run through the thrown rail switch against its thrown position so as to force rail point 24*a* away from rail 18 and rail point 22*a* against rail 20, the coil spring 126*b* will accommodate such rail point movement without damage to the various components of the rail switch actuating mechanism or stand 100. Similarly, after the train has run through the rail switch against its thrown position, the compression spring 126*b* will return the rail points to their thrown positions. The pressure relief valve 150*a* similarly relieves pressure from the head end of cylinder in the event fluid pressure in the head end exceeds a predetermined safe magnitude.

Figure 6:
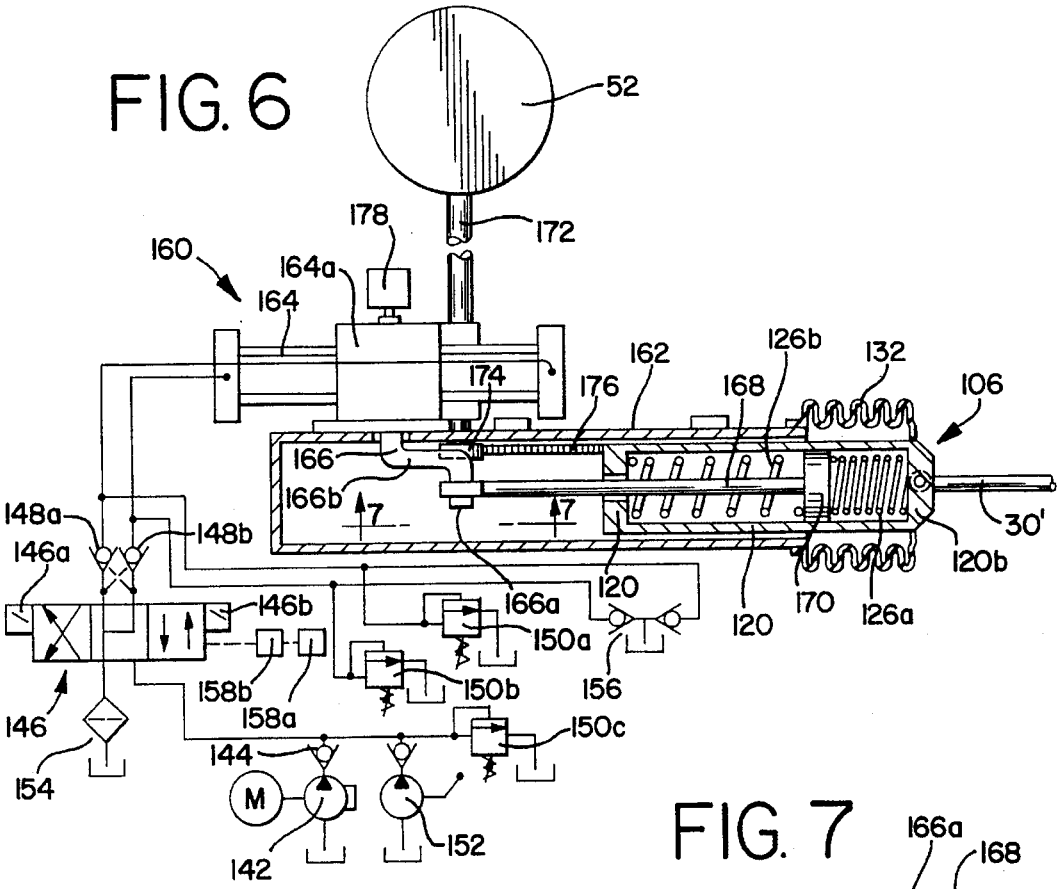
FIG. 6 is an elevational view, partially in section, of an alternative low profile railroad switch stand or actuating mechanism in accordance with another embodiment of the present invention, an associated control circuit being shown schematically.
Figure 7:
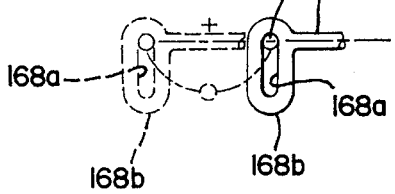
FIG. 7 is a fragmentary detail view taken substantially along lines 7—7 of FIG. 6.

FIGS. 6 and 7 illustrate another alternative embodiment of a railroad switch stand, indicated generally at 160, constructed in accordance with the present invention. The railway switch stand 160, which may also alternatively be termed a low-profile rail switch actuating mechanism, includes frame means in the form of a generally cylindrical housing 162 which is adapted for mounting on a base plate, such as the base plate 108, which in turn either directly or through mounting plates 42'*b* and 42'*b* facilitates mounting of the rail switch actuating mechanism on and between a pair of rail ties such that the longitudinal axis of the cylindrical housing 162 is axially aligned with a throw rod 30'.

The cylindrical housing 162 supports rail switch actuating means in the form of an externally mounted hydraulic or pneumatic rotary actuator 164 which cooperates with a constant force spring actuator 106 to apply a substantially constant longitudinal force to the throw rod 30' when effecting movement of a rail switch, such as rail switch 12 illustrated in FIG. 1, between open and thrown positions.

The rotary actuator 164, which may alternatively be termed the power actuating means or fluid pressure actuating means, is of known design, such as commercially available from Parker Hannifin Corporation, and has an internal piston (not shown) cooperative with a gear housing 164*a* to effect rotational reciprocating movement of a generally L-shaped crank arm 166 which extends into the cylindrical housing 160. The crank arm 166 has a downwardly directed outer end 166*a* formed on an arm portion 166*b* and received through an elongated slot 168*a* formed in a connector end 168*b* on an elongated actuating shaft 168. The elongated slot 168*a* is formed transverse to the longitudinal axis of the actuating rod 168 and forms a sliding connection with the end 166*a* of crank arm 166 to facilitate the arcuate path traversed by the crank arm end.

The actuating rod 168 extends into the constant force spring actuator 106 which is substantially identical to the constant force spring actuator 106 employed in the switch stand 100. To this end, the actuating rod 168 has a piston 170 fixed on its end within a generally cylindrical housing 120 of the spring actuator and is acted on by a pair of identical constant force coil compression springs 126*a* and 126*b* which react with the piston 170 to urge the housing 120 to a position wherein the piston is centered within the housing 120. The cylindrical housing 120 is slidably supported by cylindrical housing 162.

A target support shaft 172 is supported by the housing 162 so as to extend substantially vertically upwardly therefrom with the upper end of the target support shaft supporting a circular target 52. The support shaft 172 extends into the housing 162 and has a pinion gear 174 fixed on its lower end for meshing relation with a rectilinear rack gear 176 fixed to and movable with the housing 120 of the constant force spring actuator 106.

In the illustrated embodiment, the rotary actuator 164 is connected in a hydraulic control circuit which is substantially similar to the hydraulic control circuit illustrated in FIG. 5 and has similar components represented by similar reference numerals. It will be understood that the rotary actuator could be connected in a similar pneumatic control circuit.

The operation of the switch stand or rail switch actuating mechanism 160 is similar to actuation of the switch stand or rail switch actuating mechanism 100. To this end, hydraulic or pneumatic pressure selectively applied to the ends of the rotary actuator 164 will effect movement of the crank arm 166 through substantially 180° whereby to effect a corresponding longitudinal movement of the actuating rod 168. Such movement of the actuating rod 168 causes the constant spring force actuator 106 to apply a corresponding longitudinal force to the throw rod 30' to open or throw the track ends or switch points 22*a* and 24*a* of the rail switch 12. A position limit switch 178 is mounted on the gear housing 164*a* and serves to limit rotation of the crank arm 166 through 180° arcuate movement with each successive reversal responsive to pressurizing alternate ends of the fluid pressure actuating cylinder 164.

In similar fashion to the switch stand 100, the constant force spring actuator 106 of the switch stand 160 serves to apply a substantially constant axial force to the throw rod 30' to maintain the switch points in their open and thrown positions, while accommodating overload due to inadvertent longitudinal movement of the throw rod due to a train passing through the rail switch when thrown against such train movement. Similarly, the constant force spring actuator 106 serves to automatically reset the rail switch after a train has passed through the rail switch against its thrown position. Also, should the magnitude of the force supplied to the spring actuator 106 by the throw rod 30' be greater than the pressure setting of the pressure relief valves 150*a* and 150*b*, pressure will be released from the associated end of the fluid pressure actuating cylinder 164 to accommodate rotation of the crank arm 166 without damage to the various components.

A feature of the switch stand 160 is that the arm portion 166*b* of the crank arm 166 is axially aligned with the actuating shaft 168 and throw rod 30' when the rail switch points are in their fully open or fully thrown positions. In this manner, a longitudinal force applied to the throw rod, such as by a train running through the rail switch 12 when lined against it, will not create a rotational or torque moment on the crank arm tending to rotate it. By preventing such a rotational moment, the hydraulic or pneumatic pressure applied to the rotary actuator 164 may be terminated during intervals between switching of the rail switch points from open to thrown positions, or vice versa, without release of the axial force applied to throw rod 30' by the spring actuator 106.

Figure 8:
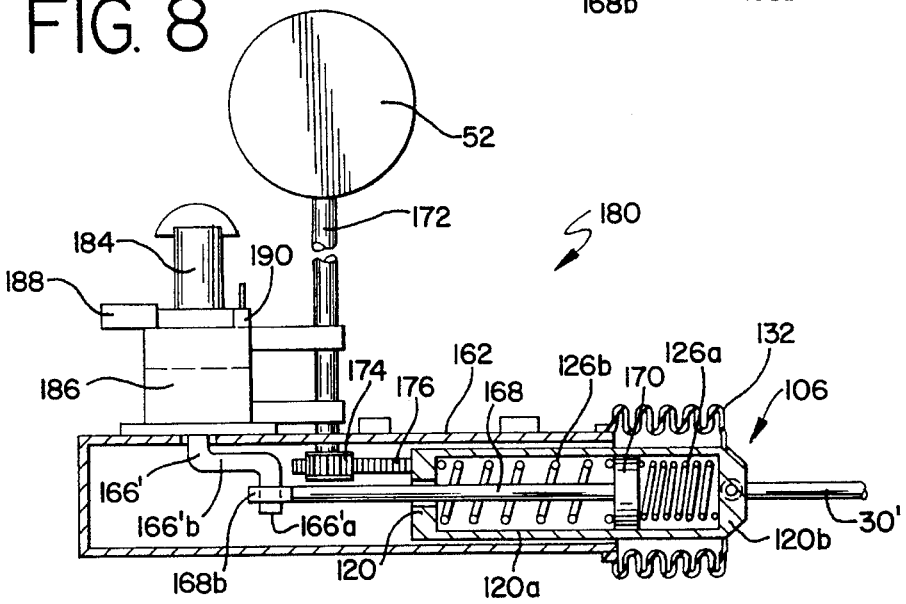
FIG. 8 is an elevational view, partially in section, of a railroad switch stand in accordance with still another embodiment of the present invention.

FIG. 8 illustrates another embodiment of a railroad switch stand, indicated generally at 180, constructed in accordance with the present invention. The switch stand 180, which may also be termed a low-profile rail switch actuating mechanism, is similar to the railroad switch stand 160 except for the power actuating means to effect longitudinal movement of the actuator rod 168 and constant force spring actuator 106 which is pivotally connected to a rail switch throw rod 30'. Thus, the switch stand 180 includes a cylindrical housing 162 adapted for mounting on and between a pair of rail ties such as aforedescribed in respect to the switch stand 160. The power actuating means for the switch stand 180 includes an electric drive motor 184 the output shaft of which is connected to a gear reducer 186 supported on the housing 162. The gear reducer 186 has a generally L-shaped output crank arm 166' which extends into the cylindrical housing 162. The housing 162 also supports an upstanding target support shaft 172 the lower end of which extends within the housing 162 and has a pinion gear 174 in meshing relation with a rack gear 176 which is fixed to and moves with the housing 120 of the constant force spring actuator 106.

A position limit switch 188 cooperates with the gear reducer 186 and motor 184 to limit rotational movement the crank arm 166' to 180° during each successive alternating rotation of the crank arm responsive to successive energizing impulses to motor 184. A manual actuator, indicated schematically at 190, is mounted on the gear reducer 186 and enables manual rotation of the crank arm 166' to open or throw the associated rail switch in the event of a power failure to the motor 184. As with the switch stand 160, the crank arm 166' is positioned with arm portion 166'*b* axially aligned with the actuating shaft 168 and throw rod 30' when the rail switch is in either its fully open or thrown positions. Thus, an axial force applied to throw rod 30', such as experienced when a train car runs through the switch when lined against it, will act along the axis of arm portion 166'*b* without creating a moment about the rotational axis of the crank arm. The crank arm 166' thereby maintains the axial force applied to the throw rod 30' by the spring actuator 106 in the event power to the drive motor 184 is lost or temporarily terminated as between rail switch operation.

In similar fashion to the switch stands 100 and 160, the switch stand 180 enables the electrical power circuit to the motor 184 to be controlled by a conveniently positioned push button type control switch located at the switch stand site, such as the control switch 93 illustrated in FIG. 2, or adapted for remote control through a suitable transmitter and receiver which would enable a locomotive engineer to throw the associated rail switch, or open it, without leaving the locomotive as it approaches the rail switch either on the main track 14 or when on the siding 16, with remote reversal of the rail switch position after passing through the rail switch. Similarly, the targets 52 associated with the switch stands 160 and 180 are directly interconnected to the rail switch throw rod 30' through the associated pinion gears 174 and gear racks 176 so that the targets provide a continual visual indication of the exact position of the corresponding rail switch.

While preferred embodiments of a switch stand or rail switch actuating mechanism in accordance with the present invention have been illustrated and described, it will be understood to those skilled in the art the changes and modifications may be made therein without departing from the invention in its broader aspects. Various features of the invention are defined in the following claims.

What is claimed is:

1. A low profile railroad switch stand for use in actuating a rail switch of the type having a throw rod responsive to longitudinal movement to effect open and thrown positions of the rail switch, said switch stand comprising first actuator means including a longitudinally moveable actuating rod, and second actuator means including a constant force spring actuator including a housing adapted to receive said actuating rod therein, a piston fixed on said actuating rod internally of said housing, and constant force spring means cooperative with said housing and said piston to normally bias said housing to a position wherein said piston is generally centered along the longitudinal length of said housing, said housing having a closed end adapted for connection to the throw rod, said spring means being adapted to apply a substantially constant longitudinal force to the throw rod in response to actuation of said first actuator means so as to maintain the rail switch in thrown or open positions.

2. A railroad switch stand for use with a rail switch of the type having a throw rod longitudinally moveable between first and second positions to effect open and thrown switch positions, said switch stand comprising, in combination, first actuating means including a rotatable crank arm, an actuating rod operatively connected to said crank arm so as to effect longitudinal movement of said actuating rod in response to rotation of said crank arm, and second actuating means interconnected to said actuating rod and adapted for coupling to the throw rod, said second actuator means being responsive to actuation of the first actuator means to apply a substantially constant axial force to the throw rod when the throw rod is in its first and second positions, said crank arm being disposed in axial alignment with the throw rod when in its first and second positions such that no moment is imparted to said crank arm by a longitudinal force acting on the throw rod when in its first or second positions.

3. A railroad switch stand as defined in claim 2 wherein said switch stand further includes signal means operatively associated with said second actuating means so as to provide a visual indication of the exact position of the rail switch.

4. A railroad switch stand as defined in claim 2 wherein said first actuator means includes a fluid pressure actuated rotary actuator operatively connected to said crank arm, and control means for pressurizing the rotary actuator and selective rotation of said crank arm to effect longitudinal movement of said actuating rod.

5. A railroad switch stand as defined in claim 2 wherein said second actuator means includes a constant force spring actuator having a housing adapted to receive said actuating rod therein, a piston fixed on said actuating rod within said spring actuator housing, and constant force spring means interposed between said piston and said spring actuator housing such that longitudinal movement of said piston in response to actuation of the first actuator means applies a substantially constant longitudinal force to said throw rod.

6. A railroad switch stand as defined in claim 2 wherein first actuator means comprises power means selectively operable to rotate said crank arm and effect longitudinal movement of said actuating rod in forward and reverse directions, said second actuating means comprising constant force spring actuator means cooperative with said actuating rod to open and throw the rail switch in response to forward and reverse movement of said actuating rod.

7. A railroad switch stand as defined in claim 2 wherein said first actuator means includes an electrical motor.

8. A railroad switch stand as defined in claim 2 wherein said first actuator means further includes rotary actuator means operatively coupled to said crank arm.

9. A railroad switch stand as defined in claim 5 wherein said constant force spring means comprises a pair of substantially equal compression springs acting on opposite ends of said piston, said springs being operative to provide overload protection of the throw rod in the event the throw rod is subjected to an extraneous force acting against the intended position of the rail switch, said springs being operative to effect automatic reset of the rail switch when said extraneous force is released.

* * * * *